United States Patent [19]

Wilkinson

[11] 4,413,452

[45] Nov. 8, 1983

[54] BUILDING STRUCTURE

[76] Inventor: Don G. Wilkinson, 32 Palm Ave., Sarasota, Fla. 33577

[21] Appl. No.: 281,456

[22] Filed: Jul. 8, 1981

Related U.S. Application Data

[63] Continuation of Ser. No. 85,525, Oct. 17, 1979.

[51] Int. Cl.[3] ..... E04B 1/32

[52] U.S. Cl. ..... 52/82; 52/80; 52/DIG. 10

[58] Field of Search ..... 52/81, DIG. 10, 80, 52/82

[56] References Cited

U.S. PATENT DOCUMENTS

| | | | |
|---|---|---|---|
| D. 191,438 | 10/1961 | Paulson | 52/82 |
| 3,114,176 | 12/1963 | Miller | 52/81 |
| 3,346,998 | 10/1967 | Nelson | 52/81 |
| 3,445,970 | 5/1969 | Nelson | 52/81 |
| 3,640,034 | 2/1972 | Shotwell | 52/81 |
| 3,660,952 | 5/1972 | Wilson | 52/81 |
| 3,791,076 | 2/1974 | Gahler | 52/63 |
| 4,048,770 | 9/1977 | McKenzie | 52/81 |

FOREIGN PATENT DOCUMENTS

| | | | |
|---|---|---|---|
| 273146 | 1/1951 | Switzerland | 411/472 |

*Primary Examiner*—Price C. Faw, Jr.

*Attorney, Agent, or Firm*—Benjamin P. Reese, II

[57] ABSTRACT

A building system formed from a plurality of building panels of triangular shape which are continuously attached on all sides to the earth or other triangular panels thereby defining a rigid panel structure of regular geometric form. Preferably, each panel is formed from two panel sections wherein each section is formed by cutting a stock piece of rigid material, having a known or predetermined length to width dimensional ratio, along its diagonal to form two right triangular panel sections. The dimensions of each triangular panel are equal and in a preferred embodiment, the ratio of the base to the perpendicular height is unity, wherein the panel sections are formed from a stock piece of material having a length to width dimensional ratio of two to one. However, stock material of other dimensional ratios can be used such as two to three and three to four, resulting in a building system utilizing building structures of regular geometric form with varying numbers of triangular panels utilized depending upon the dimensional ratio employed.

4 Claims, 8 Drawing Figures

BUILDING STRUCTURE

This is a continuation of application Ser. No. 85,525, filed Oct. 17, 1979.

BACKGROUND OF THE INVENTION

1. Field of the Invention

This invention relates to a building system utilizing a plurality of building panels having a triangular configuration, at least two sides being equal and defined by two panel sections themselves each configured into a right angle triangle joined together such that the resulting triangular panel has a predetermined base to perpendicular height ratio. The building system incorporates a regular geometric form defined by each of the triangular building panels arranged a predetermined set orientation relative to the next adjacent building panels and where each of predetermined number of arranged groups or sets of building panels are oriented specifically relative to a predetermined disposition to accomplish low cost, easily assembled building structures defined by the regular geometric form using a minimal amount of material and labor.

2. Description of the Prior Art

Since the beginning of time, housing and overall shelter type construction has been of great importance. Many societies have continuously attempted to develop a low cost easily constructed housing assembly capable of a variety of uses including residence, storage and like applications.

This need is paramount in certain countries suffering from a lower standard of living wherein the overall population cannot afford expensive or elaborate shelter.

In such societies, there is a great need and desire for a building structure capable of being used as shelter and which can be purchased and assembled at moderate costs.

Numerous temporary and or relative permanent structures have been designed and exist in the prior art. Such structures are disclosed in the following U.S. Pat. Nos.: Quick 3,871,143; Foster 3,332,178; Grocer 3,945,160; Thommassetti 3,999,337; Johnson 3,965,626; Bomgaards 3,996,706; Boone 3,868,295; Harrison 3,016,115. While all of such structures accomplish certain specific intended uses, numerous of such types of structures are overly complex and therefore difficult to construct and or maintain. This latter inherent also of course adds to the initial cost. Therefore, such building structures, while capable of serving as adequate shelter, are not practical for wide range consumption by societies suffering from a lower standard of living.

In considering the preferable or desirable type of building structure needed, building materials are, of cource, a primary consideration. It is highly desirable to form the preferred building structures from material which is readily available and which can be assembled into the preferred building structure design with a minimum amount of wasted material, labor and assembling time once on the construction site.

SUMMARY OF THE INVENTION

The present invention relates to a building system based on the use of a number of building panels each having a triangular configuration and being of equal dimension. The triangular shaped panels are continuously attached on all three sides to a geometrically regular base and or similar triangular panels thereby forming a rigid panel-type structure of regular geometric form.

Each completed building structure or unit has a single vertical axis asymmetry. A base plan of each building structure or geometric form, in the simplist application is hexagonal. This building structure incorporates the use of triangular panels in which the base of each triangle is equal to its perpendicular height. Again, in the preferred embodiment, six such triangular panels are attached to an hexagonal base wherein each side forming the hexagonal base is equal in dimension to the base of the triangular building panel. The hexagonal arrangement is again repeated by attaching a further six triangular building panels in inverted position. The verticies of the inverted triangular panels are located at the corners of the hexagon. This latter defined assembly results in a second hexagonal shape at the upper disposition of the joined bases of the secondary triangles. This, in essence, defines the roof line of the building structure or geometric form described. This building structure is then completed by attaching six additional triangular building panels to the upper formed hexagonal roof line and joining this third additional group of triangles at contiguous sides to form an hexagonal roof portion with a single vertex.

Again, in the simplest embodiment, the above described building structure is achieved by utilizing triangular building panels wherein the base of the triangular panel is equal to the perpendicular height of the triangular panel. This ratio in turn is defined by forming each triangular building panel from two panel sections wherein each panel section is in the form of a right triangle and is itself formed by cutting a stock piece of rigid building material along its diagonal. The aforementioned ratio occurs when the stock piece of building material has a length to width ratio of two to one.

It is, of course, apparent that the subject building system can be utilized while incorporating stock building pieces having varying height to width ratios. These different ratios will in turn result in triangular building panels having different base to perpendicular height ratios. When the ratio of the triangular building panel is changed to the ratio of two to three, the utilization of the same general system may result in a building structure defined by a geometric form, having similar structural characteristics. The system can obviously be extended further by the application of other suitable ratios. More specifically, the building system of the present invention may incorporate a combination of triangular building panels having different ratios. For example triangular building panels having a base to height ratio of one to one may be interconnected to form a building base defining an octagon. Similarly, 16 triangular building panels each having a base to height ratio of one to one may be attached in alternating inverted orientation, as set forth above, to define the wall portion of the building structure. In addition, the roof portion of the building structure is formed from 8 adjacently positioned and interconnected triangular building panels each having a base to height ratio of two to three. Naturally, the length of the base of the building panels defining the roof portion and the wall portion are equal, as will be described in greater detail hereinafter.

In all such cases, the structural integrity depends upon the diaphram strength of the triangular surfaces and the continuity of the connection at each edge of the triangular building panel.

Apertures in the form of entrances and window openings, etc. can be incorporated by penetrating or forming apertures in the triangular building panels at positions spaced from the junction lines of the individual triangular panels. Also, strength characteristics may be improved by thickening the triangular building panels in certain control areas and or strengthening the side junctions or seams.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a building system based on the utilization of a plurality of triangularly configured building panels which are continuously attached on all three sides to a geometrically regular base and other similarly configured triangular panels thus forming a rigid panel-type building structure having a regular geometric form.

Figure 1:
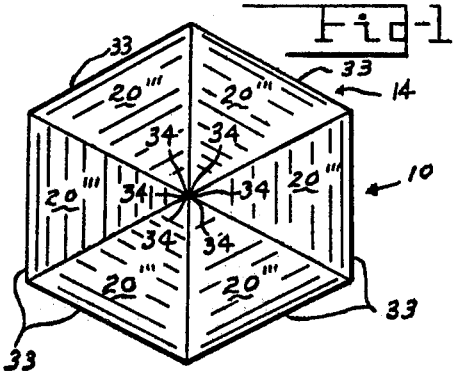
FIG. 1 is a top plane view of a building structure defined by a regular geometric form used in the building system of the present invention.
Figure 8:
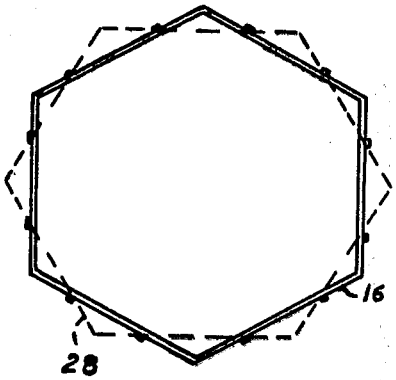
FIG. 8 is a top, essentially schematic view showing the relative positions of the floor plan and roof line, the latter being in broken lines, of a preferred embodiment of the present invention.

As shown in FIGS. 1 and 8, the building structure generally indicated as 10 is defined by a regular geometric form having a floor plan 29 and roof line 28 in the form of offset hexagons. Each such structure comprises a wall portion 12 and a roof portion 14. The building structure further comprises a base 16 serving to support and or secure the remaining building portion to the ground or other generally supporting surface 18.

Figure 2:
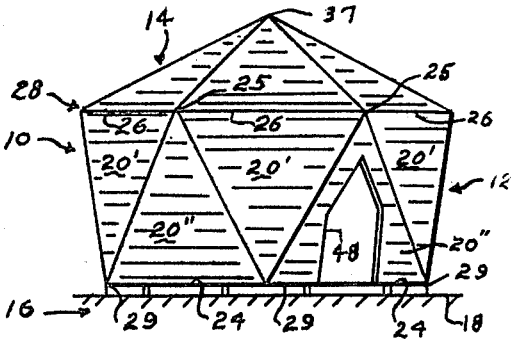
FIG. 2 is a side view of the embodiment of FIG. 1.
Figure 4:
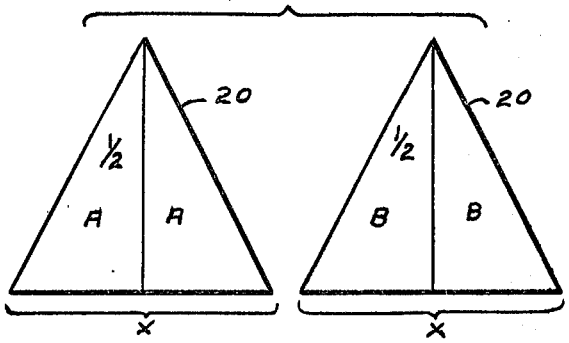
FIG. 4 is a schematic view representing the formation of the individual building panel from the panel sections of FIG. 3.

As shown in FIGS. 1, 2 and 4, each of the wall portion 12 and roof portion 14 is defined by interconnected triangular building panels 20.

Figure 3:
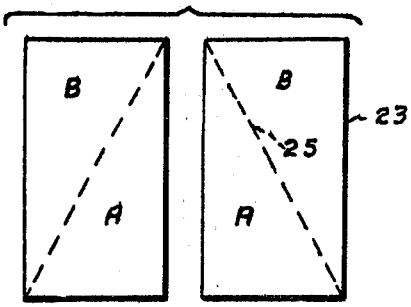
FIG. 3 is a schematic view of rigid sheet material wherein the various panel sections are defined as shown.

With regard to FIG. 3, it is an important feature of the present invention that each panel 20 is defined by two panel sections A and B wherein each panel section is formed from a rigid sheet 23 of stock material. Each panel section A and B is formed by severing the individual sheet 23 along its longitudinal diagonal 25. Accordingly, each panel Section A and B is defined by a right angle triangle so as to define the building panels 20 to have triangular configurations wherein the dimensional ratio of base (X) to perpendicular height (Y) is predetermined. (FIG. 4). More specifically, it is important to note that the dimensions of the overall structure, the individual building panels and the panel sections are such that the sheet 23 is preferably of a two to one length to width dimensional ratio. The utilization of segments A and B to form triangular panels 20 eliminates all waste or throw away material and adds to the efficiency and applicability of the subject building system to low cost housing construction.

In the preferred embodiment shown in FIGS. 1, 2, 3, 4 and 8, a length to width dimensional ratio of stock pieces of material 23 of two to one has been utilized. This dimensional ratio results in the triangular building panels 20 having a dimension ratio of base (X) to perpendicular height (Y) of one to one. The assembly of such triangular building panels in the manner described herein results in the floor plan and roof line (FIG. 8) being in the form of a hexagon and being offset relative to one another.

At this point, it should be emphasized that the building system of the present invention could incorporate the use of stock pieces of building material having dimensional ratios of height to width which differ from the two to one ratio set forth in the preferred embodiment. This, in turn, would result in different dimensional ratios of the resulting triangular building panels of base to perpendicular height which in turn would result in other conventional geometric shapes being employed in the base and/or roof line of the geometrical form defining the produced building structure. When the dimensional ratio of base to perpendicular height is changed to three to two, the incorporation of the same general building system of the present invention results in the production of a building with a varied geometrical shape than shown in FIG. 2 but with similar structural characteristics. The system can obviously be extended by the application of other suitable ratios such as three to four, etc.

Again, with regards to FIGS. 1 and 2, the wall portion 12 is defined by a first predetermined number of building panels $20^{1}$ having their bases 26 extending in end-to-end relation so as to define the peripheral line 28 of the roof. The point portion of each building panel 20 as at 29 is positioned at or along the base 16 of the overall building structure. Also, the angular inclination of each building panel 20 is such as to be angled or inclined inwardly from base 26 to point 29 wherein point 29 is located closer to the center or interior of the overall building structure 10.

Similarly, the wall portion 12 is also defined by a second predetermined number of building panels $20^{11}$ arranged in spaced relation to one another and alternately between the first predetermined number of building panel $20^{1}$. Opposite to the physical orientation of panels $20^{1}$, the second predetermined number of building panels $20^{11}$ have their bases 24 arranged in end-to-end relation to one another along or at or about the base 16 of the building structure. The correspondingly positioned ends of adjacent building panels $20^{11}$ also define the junction of the points 29 at or about the base 16. The angular orientation of the building panels $20^{1}$ is such that the respective bases 24 are located closer to the interior or center of the building structure 10 thereby disposing the points 25, connected at the periphery 28 of the roof line outwardly in an inclining relation and farther from the center of the building structure 10.

The roof portion 14 is also defined by a predetermined number of building panels $20^{111}$ connected in a continuous adjacent relation to one another wherein the respective bases of each building panel $20^{1}$ as at 33 further at least partially define the periphery 28 of the roof line along with the base 26 of building panels $20^{1}$. The corresponding points of each building panel $20^{111}$ as at 34 are joined together at a common vertex 37 forming the top most center of the building structure.

In the preferred embodiment, the building panels defining the first predetermined number, second predetermined number and roof portion are equal in number. When, as in the preferred embodiment, the dimensional ratio of length to width of sheet 23 is two to one, the base to perpendicular height of panel 20 is unity. This results in a total number of 18 panels being utilized. Of course, varying numbers of panels will be required to form the geometrical shape of each building structure, dependent on the length to width ratios used.

Figure 5:
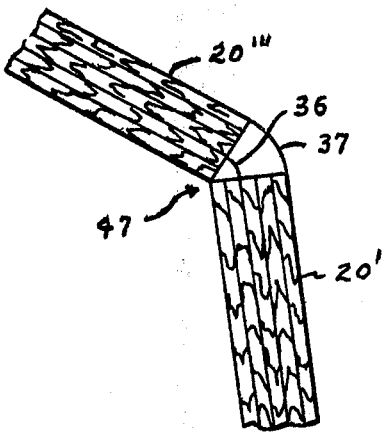
FIG. 5 is the joining and or junction structure between the peripheral edges of the individual building panels forming the structure.

With regard to FIG. 5, each of the junctions of the peripheral edges of each building panel $20^{1}$ and $20^{11}$ and or each of the roof panels $20^{111}$ is formed preferably by a first bead of adhesive material 36 which effectively serves as a hinge means such that the relative positions of the building panels $20^{1}$ and $20^{111}$ are properly positioned and still interconnected. Finally, when such relative positions are obtained a final bead and/or filling of adhesive material as at 37 is filled to secure the individual panels $20^{111}$ and $20^{1}$ together. In addition, connector elements such as staple means are interconnected to adjacently positioned edges either before or after the provision of the adhesive to add additional support to the interconnected building panels.

Figure 6:
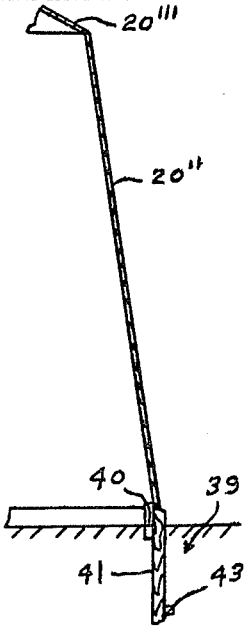
FIG. 6 is a cross-sectional view and partial cut-away showing the roof portion, wall portion and anchor or base of the building structure.

With regard to FIG. 6, the base and overall floor structure may be formed by adding a building panel $20^{11}$ to an anchor means generally indicated as 39 by means of a border 40 supported on an anchor arm 41 with an outward projection 43 to prevent inadvertent removal of the anchor arm 41.

Figure 7:
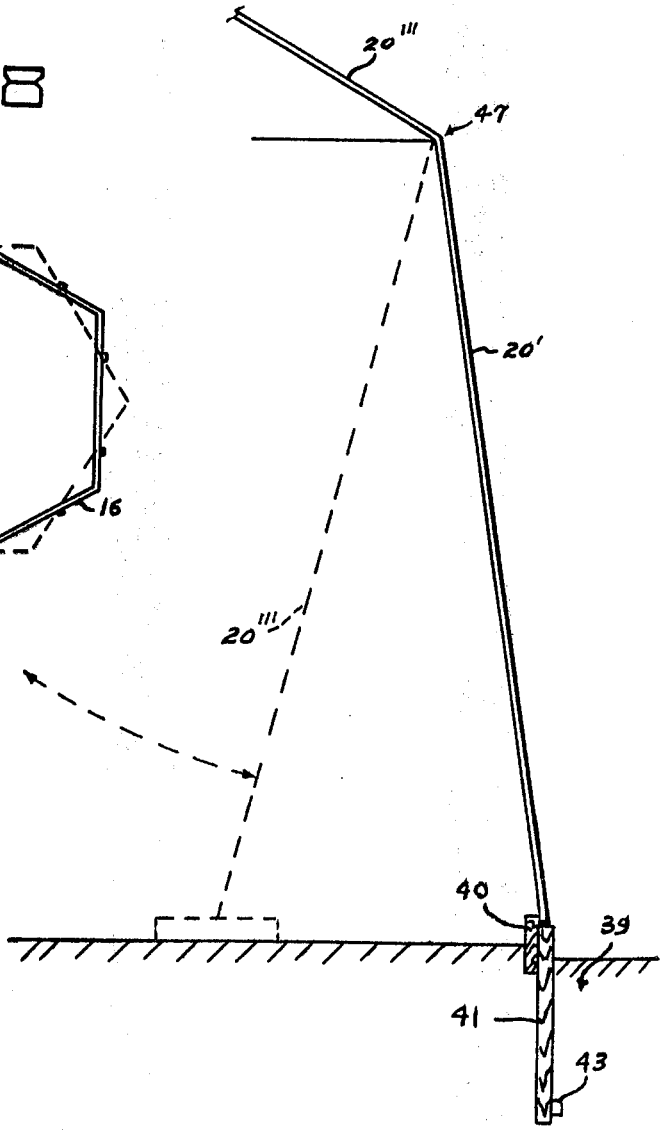
FIG. 7 is a cross-sectional view and partial cut-away showing means of attaching the roof portion to the remainder of the building section.

With regard to FIG. 7, positioning of the various building panels $20^{111}$ defining the roof portion may be accomplished by first positioning the panels $20^{111}$ in the locations depicted by the broken lines shown in FIG. 7 until all the building panels $20^{1}$ and $20^{11}$ forming the wall portions are securely positioned. Then, each of the building panels $20^{111}$ is raised about the hinge point 47 (see FIG. 5). Once the building panel $20^{111}$ is disposed in its properly angular oriented position, the additional adhesive 37 is added and or staples may be supplied to secure the relative positions of the building panels in interconnecting jointly supporting relationship to one another.

Finally, another structural feature of the present invention comprises an integral forming of openings as at 48 directly into the building panels $20^{11}$. This is due to the fact that the angular inward inclination of the building panel $20^{1}$ prevents water entering the opening during the rain or other adverse weather conditions.

It will thus be seen that the objects set forth above, among those made apparent from the preceding description, are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, What is claimed is:

1. A building structure, comprising a plurality of identical triangular panels positioned and joined in an edge-to-edge array to define an essentially hexagonal geometric shape which functions as a roof and sidewalls, each of said triangular panels being formed from a rectangular panel having a two-to-one length to width dimensional ratio by diagonally cutting said rectangular panel to form two identical right triangular panel elements, each of said right triangular panel elements having a one-to-one base to perpendicular height dimensional ratio, and joining said right triangular panel elements along their respective perpendicular height dimensions.

2. A building structure as recited in claim 1, further comprising a geometrically regular base and floor.

3. A building structure as recited in claim 2, wherein said base comprises a plurality of anchor arms which support the triangular panels in said edge-to-edge array which function as the sidewalls of the building structure.

4. A building structure as recited in claim 1, wherein the edges of adjacent triangular panels are joined by an adhesive material.

* * * * *

UNITED STATES PATENT AND TRADEMARK OFFICE

CERTIFICATE OF CORRECTION

PATENT NO. : 4,413,452

DATED : November 8, 1983

INVENTOR(S) : Don G. Wilkinson

It is certified that error appears in the above-identified patent and that said Letters Patent is hereby corrected as shown below:

In Claim 1, Column 6, Line 37, "one-to-one" should be -- one-to-two --.

Signed and Sealed this

*Fourth* Day of *February 1986*

[SEAL]

*Attest:*

DONALD J. QUIGG

*Attesting Officer*

*Commissioner of Patents and Trademarks*